US008336855B2

(12) United States Patent
Griffiths

(10) Patent No.: US 8,336,855 B2
(45) Date of Patent: Dec. 25, 2012

(54) ANTLER HOLDER

(76) Inventor: Derek Griffiths, Milford, UT (US)

( * ) Notice: Subject to any disclaimer, the term of this patent is extended or adjusted under 35 U.S.C. 154(b) by 523 days.

(21) Appl. No.: 12/545,049

(22) Filed: Aug. 20, 2009

(65) Prior Publication Data

US 2010/0044655 A1 Feb. 25, 2010

Related U.S. Application Data

(60) Provisional application No. 61/090,816, filed on Aug. 21, 2008.

(51) Int. Cl.
*B66F 19/00* (2006.01)

(52) U.S. Cl. ..... 254/1; 269/3; 269/6

(58) Field of Classification Search ..... 269/1, 3, 269/6, 95, 71, 75, 329
See application file for complete search history.

(56) References Cited

U.S. PATENT DOCUMENTS

| | | | | |
|---|---|---|---|---|
| 453,008 | A | 5/1891 | Kaempfer | |
| 1,514,262 | A * | 11/1924 | Santmyer | 254/98 |
| 2,003,896 | A | 6/1934 | Menger | |
| 2,483,239 | A * | 9/1949 | Sharpe | 91/167 R |
| 2,939,364 | A | 6/1960 | Doswell et al. | |
| 3,831,642 | A | 8/1974 | Greeott | |
| 3,929,228 | A | 12/1975 | Margolin | |
| 3,989,215 | A | 11/1976 | Weston | |
| 4,055,211 | A | 10/1977 | Sperling | |
| 4,106,736 | A | 8/1978 | Becker et al. | |
| 4,253,649 | A * | 3/1981 | Hewson | 269/45 |
| 4,464,440 | A | 8/1984 | Dotzman | |
| 4,549,713 | A | 10/1985 | Magadini | |
| 4,717,626 | A | 1/1988 | Badger | |
| 4,914,940 | A * | 4/1990 | Hebert | 72/392 |
| 4,971,865 | A | 11/1990 | Nowlan | |
| 5,015,532 | A | 5/1991 | Knight | |
| 5,069,411 | A | 12/1991 | Murphy | |
| 5,110,080 | A | 5/1992 | Rieman | |
| 5,453,307 | A | 9/1995 | Rezmer | |
| 5,472,765 | A | 12/1995 | Green | |
| 5,484,368 | A | 1/1996 | Chang | |
| 5,503,439 | A | 4/1996 | LaJeunesse et al. | |
| 5,657,740 | A | 8/1997 | Slates et al. | |
| 5,779,294 | A | 7/1998 | Magri | |
| 5,806,826 | A | 9/1998 | Lemire | |
| 5,816,557 | A | 10/1998 | Tepper | |
| 5,873,594 | A | 2/1999 | McCoy et al. | |
| 6,003,825 | A | 12/1999 | Abernathy | |
| 6,062,525 | A | 5/2000 | Lemire | |
| 6,364,261 | B1 | 4/2002 | Vass | |
| 6,389,655 | B2 | 5/2002 | Libecco | |
| 6,550,739 | B1 | 4/2003 | Brindisi | |
| 6,561,468 | B2 | 5/2003 | Williamson | |
| 6,828,035 | B1 | 12/2004 | Goettl | |
| 7,029,045 | B2 | 4/2006 | Tumminaro | |
| 7,207,535 | B1 | 4/2007 | Giuliani | |
| 7,225,515 | B1 | 6/2007 | Hicks | |

(Continued)

*Primary Examiner* — Lee D Wilson
(74) *Attorney, Agent, or Firm* — Goff Patent Law PLLC; Jared S. Goff

(57) ABSTRACT

According to one embodiment, a first engaging surface can be configured to engage a first region of an antler set, and a second engaging surface can be configured to engage a second region of the antler set. A support structure can support the first and second engaging surfaces. The support structure can be configured to adjust a distance between the second engaging surface and the first engaging surface to inhibit shrinking of a distance between the first and second regions of the antler set.

10 Claims, 5 Drawing Sheets

U.S. PATENT DOCUMENTS

| | | | | |
|---|---|---|---|---|
| 7,311,294 | B1 * | 12/2007 | Ruan | 254/108 |
| 2002/0187885 | A1 | 12/2002 | Liao | |
| 2003/0082024 | A1 | 5/2003 | Scott | |
| 2004/0033117 | A1 | 2/2004 | Brown et al. | |
| 2006/0051179 | A1 | 3/2006 | Scott | |
| 2010/0044655 | A1 * | 2/2010 | Griffiths | 254/1 |

* cited by examiner

ANTLER HOLDER

RELATED APPLICATIONS

This is a non-provisional application claiming priority to U.S. provisional application No. 61/090,816, entitled A DEVICE TO HOLD THE ACTUAL OR TRUE WIDTH OF A TROPHY BIG GAME ANIMAL'S ANTLERS, filed Aug. 21, 2008, which is incorporated herein by reference.

BACKGROUND

Hunters who kill animals with large antlers (or sometimes small antlers) often consider the antlers to be prized possessions. As used herein, antlers refer to any type of horns or antlers protruding from an animal, and are not limited to those that are shed each year. Of course, animals with larger antlers are typically considered superior to animals with smaller animals. Some such animals may be considered "trophy" animals. The antlers and sometimes all or part of the remainder the animal's body are often preserved using taxidermy techniques, and the resulting preserved antlers are often displayed. In addition, the antlers are often scored, and animals with high scores are often included in record books such as the Boone and Crocket record books. Such record books typically require the antlers to dry for a set period of time (such as 60 days), which is sometimes referred to as the drying period. During the drying period, the antlers will often shrink so that their dimensions are less than the original dimensions of the antlers when the animal was killed. Accordingly, people have sometimes wedged boards between the two antlers in an animal's set of antlers in an attempt to prevent such shrinking during the drying period and to keep the antlers as close to their original width as possible.

SUMMARY

The present inventor has found that the previous method of wedging a solid board between the antlers is cumbersome and inefficient. While a single board may be solid, often such a board must be cut several times to get the right length, it can be difficult to wedge into place, and it can easily slip out of place. In addition to recognizing these problems, the inventor has discovered a different way of addressing the problem of shrinking antlers.

According to one embodiment, a first engaging surface can be configured to engage a first region of an antler set, and a second engaging surface can be configured to engage a second region of the antler set. A support structure can support the first and second engaging surfaces. The support structure can be configured to adjust a distance between the second engaging surface and the first engaging surface to inhibit shrinking of a distance between the first and second regions of the antler set.

According to another embodiment, first and second regions of an antler set can be engaged by respective first and second engaging members. A distance between the engaging members can be adjusted, and the antler regions can be held using the first and second engaging members to inhibit shrinking of the antler set.

According to yet another embodiment, a first engaging member attached to a support structure can be configured to engage a first region of an antler set and a second engaging member attached to the support structure can be configured to engage a second region of the antler set. The first and second engaging members can be adjusted into an adjusted position, wherein the first engaging member engages the first region and the second engaging member engages the second region, to inhibit the first and second regions from coming closer together due to shrinking of the antler set. The first and second engaging members can be substantially maintained in the adjusted position.

This Summary is provided to introduce a selection of concepts in a simplified form. The concepts are further described below in the Detailed Description. This Summary is not intended to identify key features or essential features of the claimed subject matter, nor is it intended to be used to limit the scope of the claimed subject matter. Similarly, the invention is not limited to implementations that address the particular techniques, tools, environments, disadvantages, or advantages discussed in the Background, the Detailed Description, or the attached drawings.

BRIEF DESCRIPTION OF THE DRAWINGS

The description and drawings may refer to the same or similar features in different drawings with the same reference numbers.

DETAILED DESCRIPTION

As noted above, during the drying period, antlers often shrink so that their dimensions are less than the original dimensions when the animal was first killed. Accordingly, people have sometimes wedged boards between the two antlers in an animal's set of antlers in an attempt to prevent such shrinking during the drying period and to keep the antlers as close as possible to its original width. It is rumored that others may have used stretchable members such as tire inner tube material to pull outwardly on an animal's antlers and actually attempt to increase the width between an animal's antlers, rather than maintain the width between the animal's antlers, although this would generally be considered a dishonest and unethical practice.

The present inventor recognized the shortcomings of using a board to attempt to maintain the original dimensions of a set of antlers (as used herein a "set of antlers" refers to one or more antlers on a single animal). Specifically, the inventor found that it was difficult to cut a board to just the right length, and to get the board wedged between the antlers so that it would maintain the width of the antlers. The inventor also discovered a different way of addressing the problem of shrinking antlers, by using an adjustable apparatus to engage the antlers and inhibit shrinking of the distances between regions of the antlers that are engaged by the apparatus, such as by keeping such distances substantially the same. As used herein, "substantially," when referring to distances or dimensions being maintained or staying the same, should not be construed to mean exactly the same. Rather, it refers to keeping the dimensions the same within reasonable tolerances, as might be expected when the antlers are held by a structure that includes rigid members with typical engineering tolerances. The antler holders can be used to inhibit shrinking and keep antlers at substantially their original width or other original dimension during a drying period. This could keep one or more dimensions of trophy and record animals' antlers, or even smaller antlers, at substantially their original values.

Figure 1:
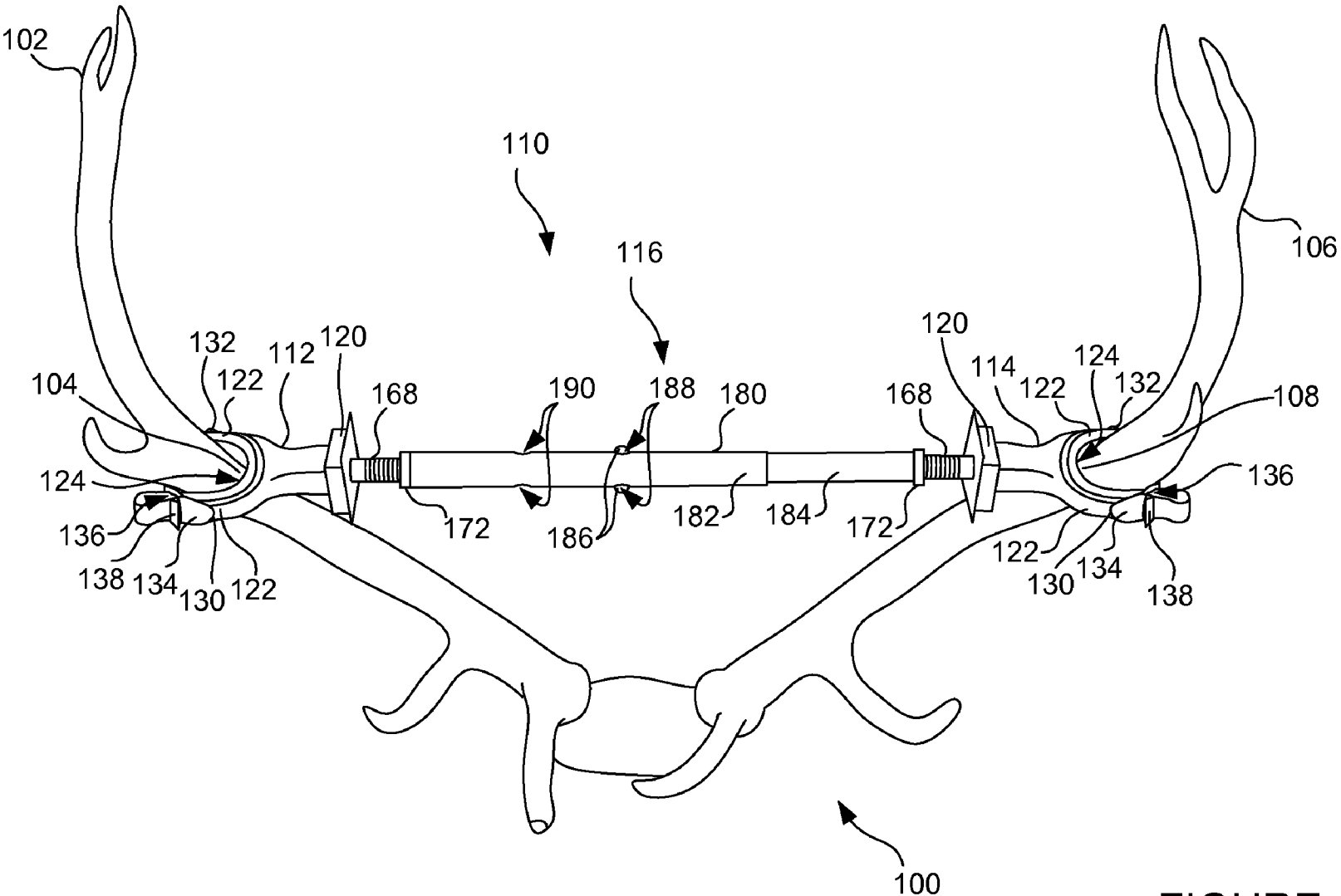
FIG. 1 is a perspective view of an antler holder engaging a set of antlers.

Referring to FIG. 1, an antler set (100) can include a first antler (102) having a first region, and a second antler (106) having a second region (108). For example, the antlers can be a set of antlers that are drying, where it can be desirable to inhibit shrinking of a distance between the first region (104) and the second region (108). The regions between which it is desirable to inhibit shrinking could be any of various regions on different antlers, or on the same antler. Also, the antlers could be any of various different types of antlers.

An antler holder (110) can have multiple engaging members, such as V- or U-shaped brackets. For example, the antler holder (110) can include a first U-shaped engaging member (112) that can engage the first region (104) and a second U-shaped engaging member (114) that can engage the second region (108). An adjustable support structure (116) can hold the engaging members (112 and 114) in an adjusted position, where the engaging members (112 and 114) can engage the respective antler regions (104 and 108) to inhibit shrinking of a distance between the regions (104 and 108). The engaging members (112 and 114) may be able substantially to maintain an initial distance between the regions (104 and 108) and between the engaging members (112 and 114).

Figure 3:
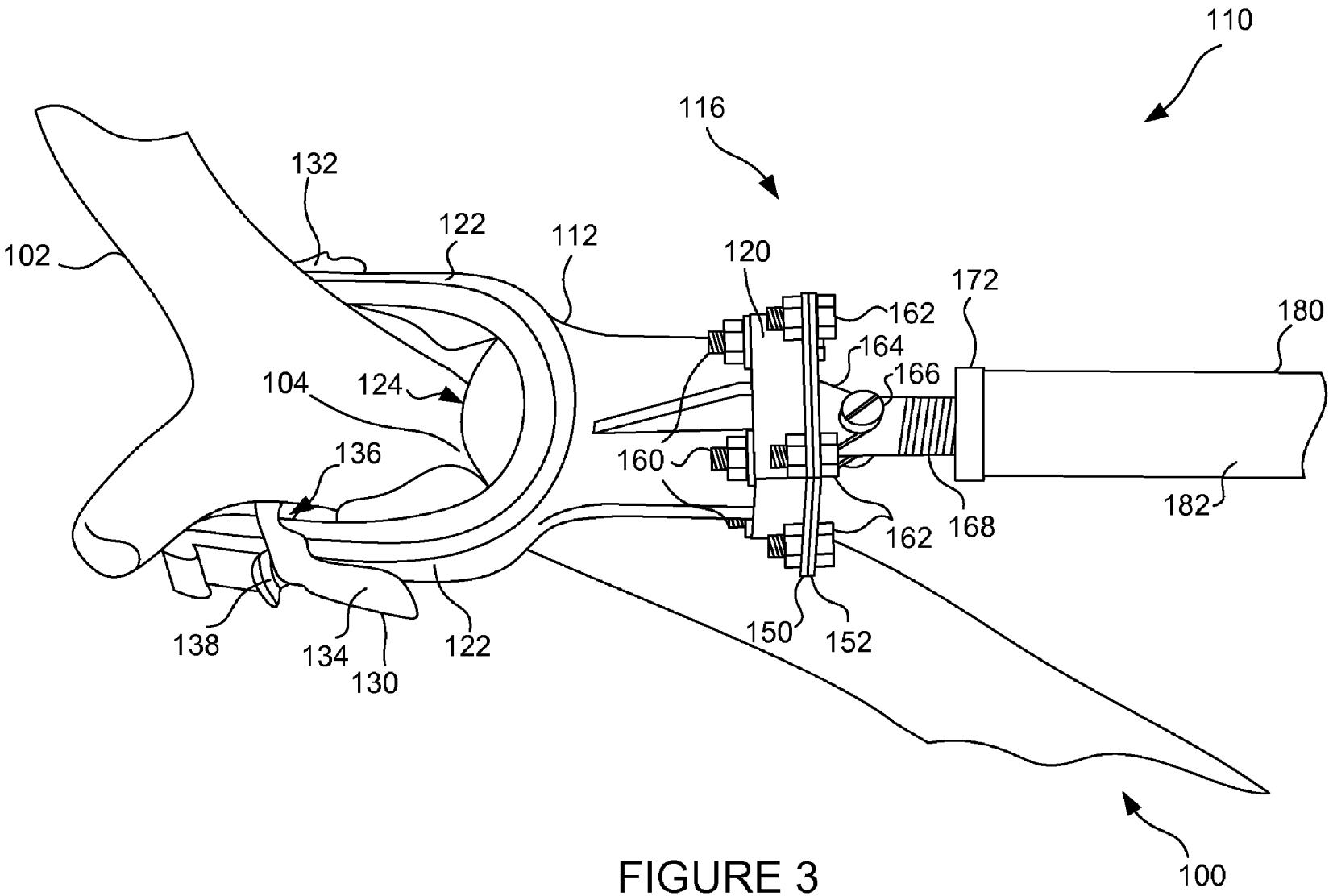
FIG. 3 is a broken away perspective view of an end of an antler holder similar to FIG. 1 with an engaging member engaging a set of antlers.

The two engaging members (112 and 114) can be mirror images of each other. Referring now to FIG. 3, the first engaging member (112) and the end of the support structure (116) adjacent to the first engaging member (112) are illustrated. Each engaging member (112 and 114) can include a base (120), and the base can fork into a pair of tines (122), with an engaging surface (124) being formed on the inner surface of the tines (122). The engaging surface (124) may be a continuous or discontinuous surface, but it is positioned to engage the respective antler region (104 or 108). The engaging members (112 and 114) can also each include a strap (130), which can have a fixed end (132) fixed to one tine (122) of the engaging member (112 or 114) and a releasable end (134) that can be releasably attached to the other tine (122). For example, the releasable end (134) can define a hole (136) therein, which can be fitted over the tine (122), and a strap protrusion (138) on the tine (122) can engage the releasable end (134) of the strap (130) to keep it on the tine (122). Thus, the strap (130) can extend around the antler (102 or 106) to keep it cradled in the tines (122). Alternatively, the strap (130) may be omitted, and the pressure between the antler (102 or 106) and the respective tines (122) can keep the antler (102 or 106) cradled in the tines (122).

The engaging surfaces and engaging members could take various other forms. For example, the engaging members could be cables that loop around the respective antler regions, and a support structure could keep the cables taut by pulling outwardly on the cables. As another alternative, such cables could wrap tightly around the antlers to hold the antlers in place, allowing a rigid member attached to the cables to push outwardly on the antlers.

Referring still to FIG. 3, the support structure (116) can include outside mounting plates (150) that each abut a respective engaging member base (120). The support structure (116) can also include inside mounting plates (152) that each abut a respective outside mounting plate (150) opposite from the engaging member base (120). Each outside mounting plate (150) can be secured to the respective engaging member base (120) with base mounting bolts (160), and each inside mounting plate (152) can be secured to the respective outside mounting plate (150) with plate mounting bolts (162). A mounting bracket (164) can extend inwardly from each inside mounting plate (152) opposite from the respective outside mounting plate (150). Each mounting bracket (164) can include a pair of plates positioned on opposite sides of an end of a threaded rod (168), and a bracket bolt (166) can extend through the plates of the bracket (164) and through the rod (168). Accordingly, each threaded rod (168) can be secured to the respective engaging member (112 or 114).

Figure 2:
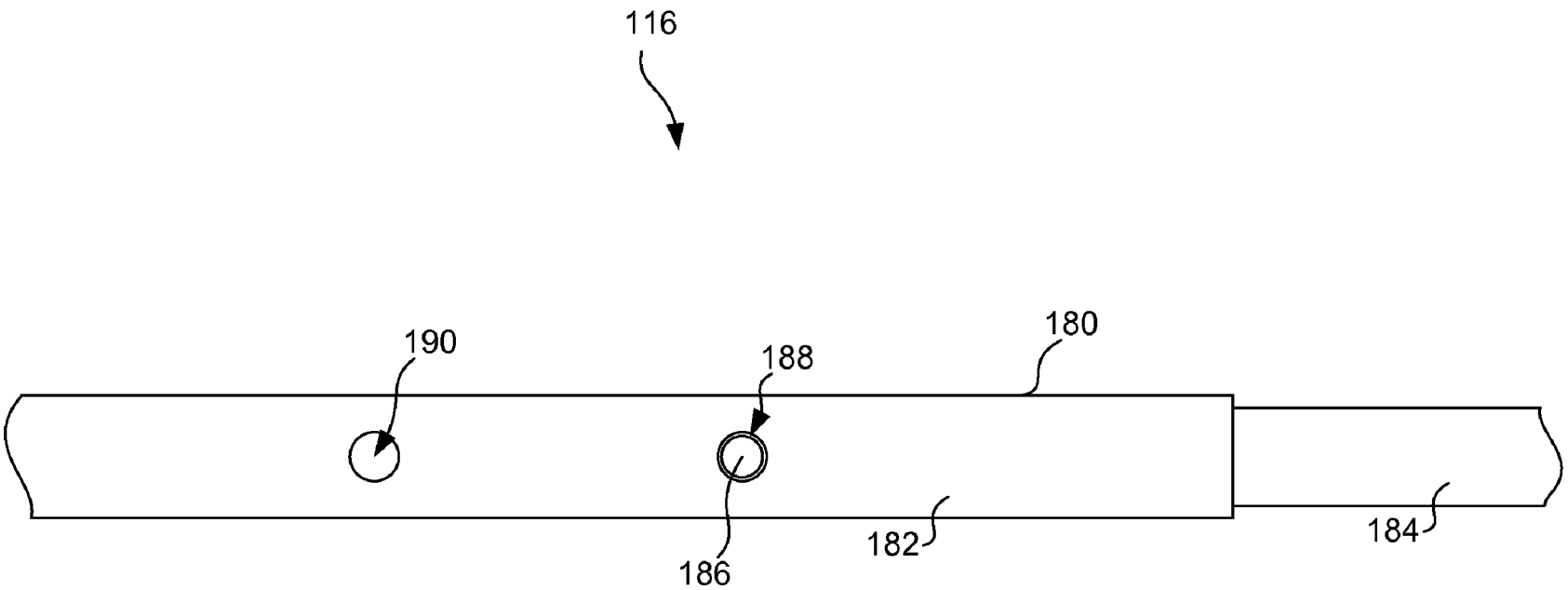
FIG. 2 is top broken away view of a portion of an adjustable bar of the antler holders of FIG. 1.

Referring to FIGS. 1-2, each threaded rod (168) can be screwed into a mating threaded insert (172), with the threaded inserts (172) being secured on opposite sides of a retractable bar, such as a telescoping bar (180). The telescoping bar (180) can include an outer bar (182) and an inner bar (184) that slides within the outer bar (182). Self-snapping pins (186) can be secured to the inner bar (184) so that the pins (186) can snap outwardly into long position holes (188) for the telescoping bar (180) to be adjusted to a longer length, and the pins (186) can snap outwardly into short position holes (190) for the telescoping bar (180) to be adjusted to a shorter length.

The antler holder (110) can be made of standard types of materials so long as the materials are sufficiently durable and sufficiently rigid for members other than the straps (130). For example, base (120) and tines (122) of the engaging members (112 and 114) can be made of metal or rigid polymer material. The tines (122), and possibly the base (120), can include an elastomeric coating such as a rubber coating to form the engaging surfaces (124). Such a coating can help to protect the antler set (100) from being scratched by the antler holder (110). The strap (130) can be made of an elastomeric material such as rubber or some other stretchable material. As an example, each engaging member can be a forked member such as those commonly used for holding rifles on all-terrain vehicles (ATV's) and motorcycles.

The outside and inside mounting plates (150 and 152) can be made of standard rigid material, such as steel. In addition, the threaded rods (168) can be a standard metal threaded rod. The telescoping bar (180) can be made of standard metal, such as is commonly used for pickup truck cargo bars. The threaded inserts (172) can be made of rigid polymer materials, although they may be made of metal such as steel.

In use, the telescoping bar (180) can be adjusted to roughly achieve a desired length by depressing the self-snapping pins (186) and sliding the outer and inner bars (182 and 184) relative to each other until the pins (186) snap into the desired holes (188 or 190). This can be done while positioning the engaging members (112 and 114) to engage the desired antler regions (104 and 108), such as with the engaging members (112 and 114) cradling associated areas where the antlers (102 and 106) branch. While two sets of holes are illustrated, it may be desirable to have a different number of holes to allow for finer adjustment with the pins (186). The straps (130) can be secured around the antlers (102 and 106) to help secure the engaging members (112 and 114) in place relative to the regions (104 and 108) of the antlers (102 and 106).

The distance between the engaging members (112 and 114) can be fine-tuned or more finely adjusted by rotating the telescoping bar (180) relative to the engaging members (112 and 114). The threads on the insert (172) and mating threaded rod (168) on one end of the telescoping bar (180) can be left-handed threads and the threads on the insert (172) and mating threaded rod (168) on the other end of the telescoping bar (180) can be left-handed threads. Thus, when the telescoping bar (180) is rotated, both threaded rods (168) can be screwed out of the bar (180) (increasing the distance between the engaging members (112 and 114)) or both can be screwed into the bar (180) (decreasing the distance between the engaging members (112 and 114)), depending on the direction of rotation of the telescoping bar (180) relative to the engaging members (112 and 114). This fine-tuning can continue until a desired pressure is achieved between the engaging members (112 and 114) and the respective antler regions (104 and 108) to inhibit shrinking of the distance between the antler regions (104 and 108) and to substantially maintain an original distance between the regions (104 and 108).

The antler holder (110) can be left on the antler set (100) for a sufficient time for the antler set (100) to pass through the drying or shrinking period, such as until about sixty days after the death of the animal.

Figure 4:
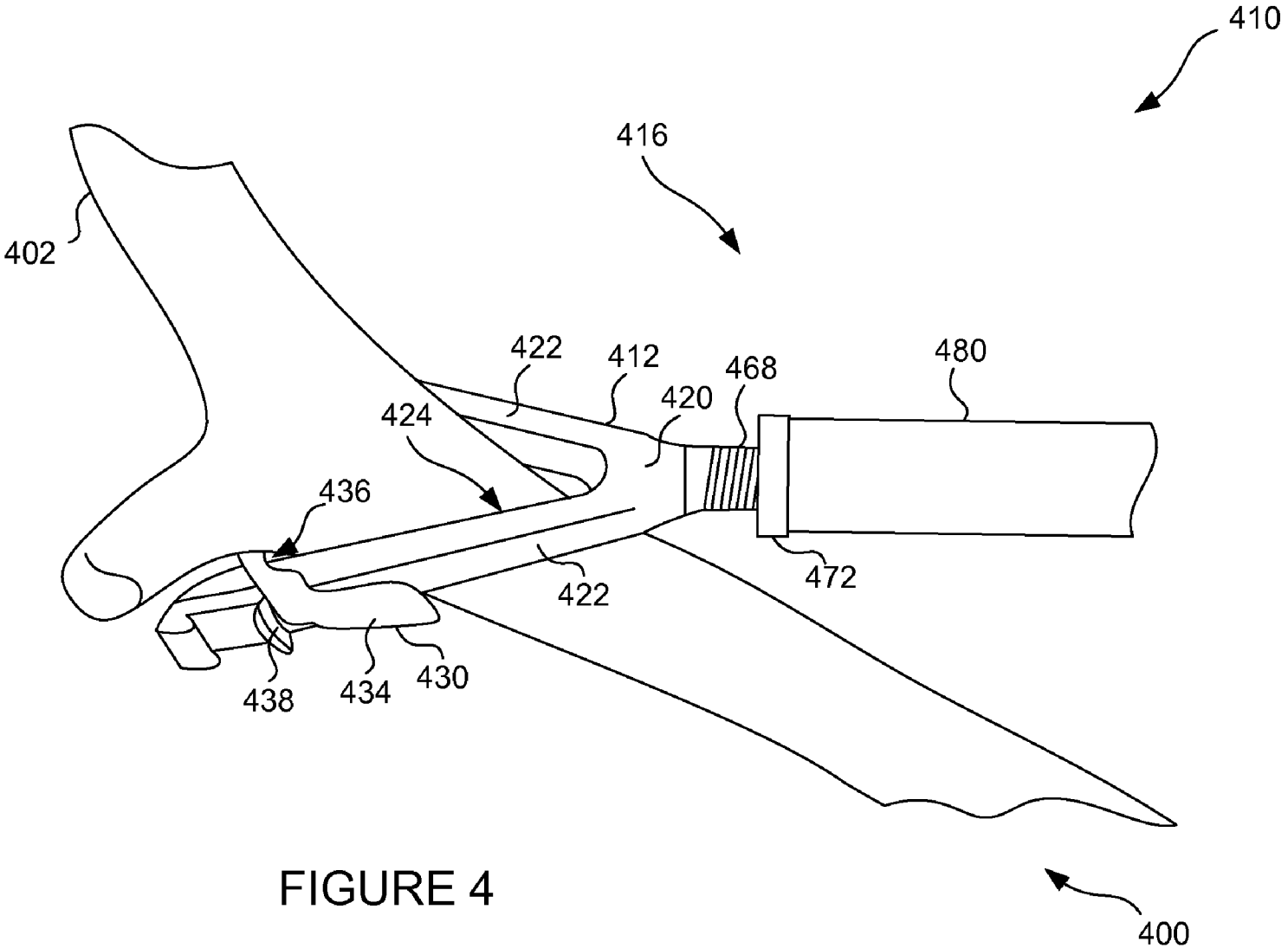
FIG. 4 is a broken away perspective view similar to FIG. 3, but with an alternative engaging member.

Referring now to FIG. 4, a portion of a first antler (402) of an antler set (400) is illustrated. An alternative antler holder (410) can be similar to the antler holder (110) of FIGS. 1-3, except that engaging members (412) can be different, and they can be secured to the support structure (416) differently. More specifically, each engaging member (412) can include a base (420) that forks into tines (422). However, rather than forming a U-shape as in FIGS. 1 and 3, the tines (422) can form a V-shape. The V-shape may be advantageous to allow the tines (422) to fit snugly on a wider range of antler sizes. Other shapes and configurations may also be used.

Engaging surfaces (424) can be formed on the tines (422). Also, each engaging member (412) can include a strap (430) with a fixed end (not shown) and a releasable end (434) having a hole (436) formed therein. A strap protrusion (438) on a tine (422) can engage the releasable end (434) to hold the end (434) in place with the strap (430) extending around the antler (402).

Each end of a support structure (416) can include can include a threaded rod (468), which can be integral with the engaging member (412) so that the respective engaging member (412) and the threaded rod (468) form a unitary part. As with the embodiment of FIGS. 1-3, the threaded rod (468) can be screwed into a respective threaded insert (472), which can be inserted into an end of a telescoping bar (480).

Figure 5:
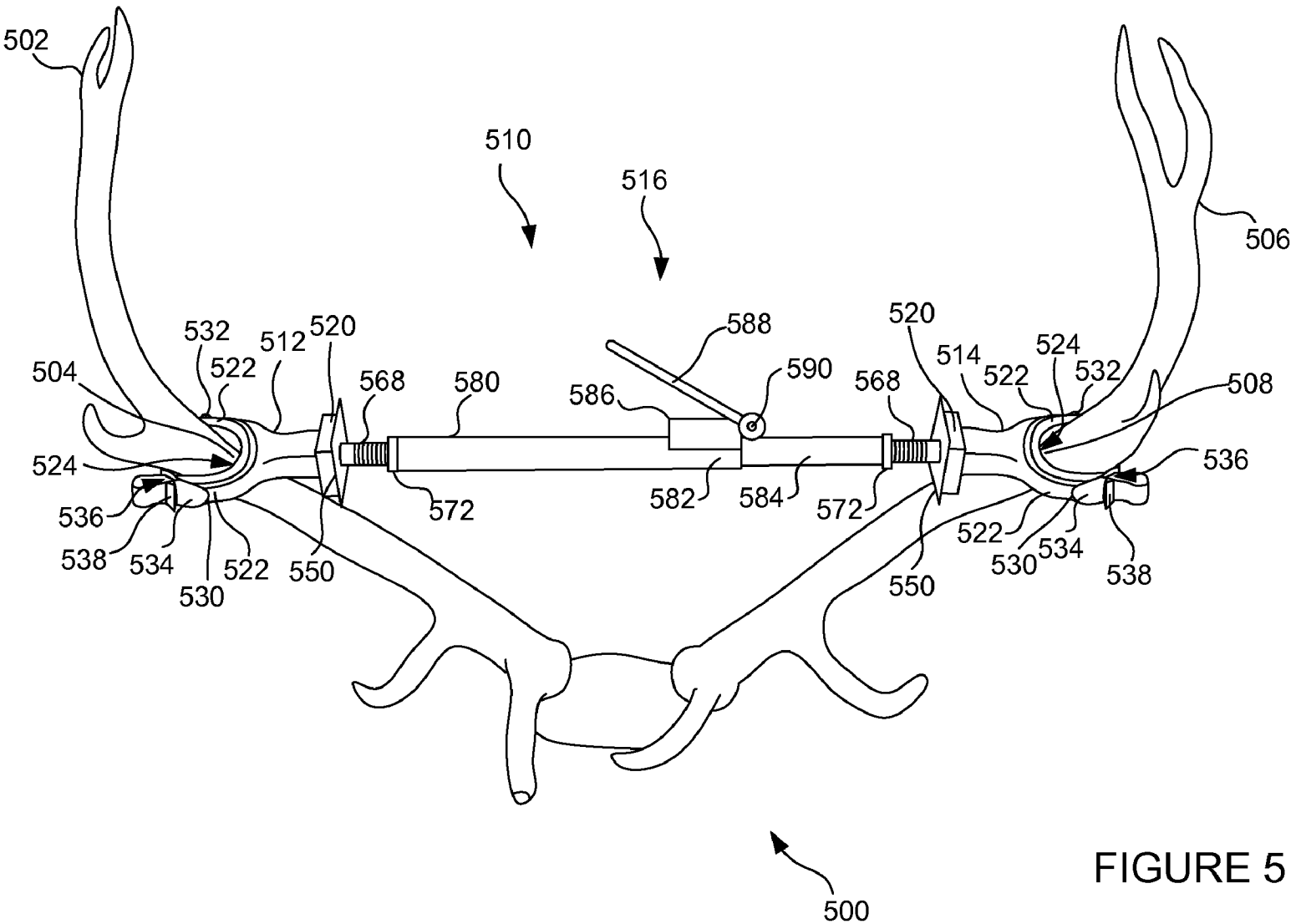
FIG. 5 is a perspective view of another antler holder engaging a set of antlers.

Referring now to FIG. 5, an antler set (500) is illustrated, with a first antler (502) having a first region (504) and a second antler (506) having a second region (508). An alternative antler holder (510) will be discussed with reference to FIG. 5. The antler holder (510) can be structured and operate similar to the antler holder (110) discussed above, with a first engaging member (512), a second engaging member (514) and a support structure (516). Each engaging member (512 or 514) can include a base (520), tines (522), an engaging surface (524), a strap (530) with a fixed end (532) and a releasable end (534) defining a hole (536), and a strap protrusion (538). As with the antler holder (110) discussed above, the support structure (516) can include mounting plates (550) (which can include inside and outside plates), base mounting bolts (not shown), plate mounting bolts (not shown), mounting brackets (not shown), bracket bolts (not shown), threaded rods (568), threaded inserts (572), and a telescoping bar (580) having an outer bar (582) and an inner bar (584). However, instead of having self-snapping pins, the support structure can include an actuator such as a ratchet device (586) having a handle (588) to operate the ratchet device (586) by moving the handle (588) back and forth along the telescoping bar (580) about a pivot (590). A body of the ratchet device (586) can be mounted on the outer bar (582), and the ratchet device (586) can include a pinion gear (not shown) that can be rotated in a standard ratcheting manner to engage holes formed in the inner bar (584) to slide the inner bar (584) in or out relative to the outer bar (582). Thus, the telescoping bar (580) can form a slider mechanism as in the embodiment of FIGS. 1-3 above, and the ratchet device (586) can form a rack and pinion device, which can actuate sliding movement of the telescoping bar (580) to adjust the bar to be longer or shorter. Similar ratchet sliding mechanisms exist on pickup truck cargo bars.

It should be noted that different actuators and different mechanisms can be employed in the support structure, so long as the support structure can be adjusted and can be held in an adjusted position to hold engaging members or surfaces in place to inhibit antler shrinking. For example, in the embodiment of FIG. 5, the threaded rods (568) and the threaded inserts (572) could be omitted, the outer bar (582) could be rigidly fixed to the first engaging member (512), and the inner bar (584) could be rigidly fixed to the second engaging member (514). Thus, the adjustment could be done solely by actuating the ratchet device (586). As another example, a different type of ratchet device could be used, where the ratchet device can actuate to rotate a bar relative to one or more threaded rods, such as those discussed above. In this embodiment, the handle for the ratchet device can rotate around the bar. Similar ratchet devices exist in ratchet chain binders. As yet another example, the telescoping bar could include more than two bars to provide additional adjustment capability. As yet another example, the support structure could include pivoting mechanisms instead of or in addition to the slider mechanisms of the telescoping bars and the threaded rods and inserts. Moreover, the antler holders could be made at least partially of different materials from those discussed herein, such as composite materials.

The subject matter defined in the appended claims is not necessarily limited to the benefits described herein. A particular implementation of the invention may provide all, some, or none of the benefits described herein. Although operations for the various techniques are described herein in a particular, sequential order for the sake of presentation, it should be understood that this manner of description encompasses rearrangements in the order of operations, unless a particular ordering is required. For example, operations described sequentially may in some cases be rearranged or performed concurrently. Techniques described herein may be used with one or more of the devices described herein and/or with one or more other devices. Moreover, for the sake of simplicity, the illustrations may not show the various ways in which particular techniques or structures can be used in conjunction with other techniques or structures.

While the invention has been particularly shown and described with reference to preferred embodiments thereof, it will be understood by those skilled in the art that various changes in form and details may be made therein without departing from the spirit and scope of the invention.

I claim:

1. A method comprising:

engaging a first region of an antler set with a first engaging member;

engaging a second region of an antler set with a second engaging member;

adjusting a distance between the first and second engaging members; and holding the first and second regions to inhibit shrinking of the antler set using the first and second engaging members.

2. The method of claim 1, wherein holding the first and second regions comprises holding the first and second regions at a substantially constant distance from each other.

3. The method of claim 1, wherein adjusting comprises sliding members of a support structure relative to each other, the support structure supporting the first and second engaging members.

4. The method of claim 1, wherein adjusting comprises actuating an actuator selected from a group consisting of a ratchet device, a threaded device, a telescoping device, and combinations of the foregoing devices.

5. The method of claim 1, wherein adjusting comprises pushing outwardly on the first and second engaging members.

6. The method of claim 1, wherein the first and second engaging members are forked.

7. The method of claim 1, wherein the first and second engaging members are V-shaped.

8. The method of claim 1, wherein holding the first and second regions comprises holding the first and second regions during a drying period.

9. The method of claim 1, wherein holding the first and second regions to inhibit shrinking of the antler set comprises the first and second engaging members inhibiting shrinking between the first and second engaging members.

10. The method of claim 9, wherein the antler set shrinks in one or more dimensions other than between the first and second engaging members while the first and second engaging members inhibit shrinking between the first and second engaging members.

* * * * *